US006240710B1

(12) United States Patent
Button et al.

(10) Patent No.: US 6,240,710 B1
(45) **Date of Patent: *Jun. 5, 2001**

(54) STAGE AND THREAD ASSEMBLY FOR HIGHSPEED ENVELOPE PACKING APPARATUS

(75) Inventors: Kevin Button, Vail; Douglas McLean; John Corradini, both of Tucson, all of AZ (US)

(73) Assignees: Bell & Howell Mail; Messaging Technologies Company, both of Durham, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,744

(22) Filed: Sep. 21, 1998

Related U.S. Application Data

(63) Continuation-in-part of application No. 08/734,632, filed on Oct. 21, 1996, now Pat. No. 5,809,749.

(51) Int. Cl.[7] ..... B65B 1/04

(52) U.S. Cl. ..... 53/473; 53/492; 53/381.5; 53/381.7; 53/569

(58) Field of Search ..... 53/569, 381.5, 53/381.7, 473, 460, 389.1, 492; 271/2, 34, 3.01, 149, 150

(56) References Cited

U.S. PATENT DOCUMENTS

| | | | | |
|---|---|---|---|---|
| 5,081,825 | * | 1/1992 | Mrozinski | 53/569 |
| 5,168,689 | * | 12/1992 | Macelis | 53/569 |
| 5,251,425 | * | 10/1993 | Kern | 53/460 |
| 5,255,498 | * | 10/1993 | Hotchkiss et al. | 53/569 |
| 5,327,705 | * | 7/1994 | Defigueiredo | 53/569 |
| 5,511,357 | * | 4/1996 | Ricketts et al. | 53/569 |
| 5,911,668 | * | 6/1999 | Auerbach et al. | 53/569 |

* cited by examiner

*Primary Examiner*—Eugene Kim
(74) *Attorney, Agent, or Firm*—Patula & Associates P.C.

(57) ABSTRACT

A stage and thread assembly is disclosed for use in a high speed envelope packing apparatus. The assembly receives from the side, a single envelope with flap open. The assembly precisely aligns and positions the envelope in a pre-stage area via a plurality of entry ramps, continuously running belts, and back stops, correcting any misalignment. Once positioned in the pre-stage area, the apparatus stages the envelope in a position above the thread roller of the high speed packing apparatus so that the envelope can be threaded on the packing plate for insertion of material into the envelope. The staging of the envelope is achieved via a plurality of rollers including, d-rollers, flipper rollers, and stage rollers. The envelope is staged in a direction perpendicular to the direction of entry of the envelope.

16 Claims, 17 Drawing Sheets

STAGE AND THREAD ASSEMBLY FOR HIGHSPEED ENVELOPE PACKING APPARATUS

This is a continuation in part of U.S. patent application Ser. No. 08/734,632 filed Oct. 21, 1996, now U.S. Pat. No. 5,809,749.

The present invention relates generally to an envelope packing apparatus, and in particular, to a stage and thread assembly for use in a high speed envelope packing apparatus. Specifically, the present invention relates to an assembly that continuously receives at high speeds, envelopes from the side with the envelope flap open, precisely aligns and positions the envelopes, moves the aligned envelopes in a direction perpendicular to the direction of entry, and stages or positions the envelopes above a threading roller so they can be threaded on a packing plate.

BACKGROUND OF THE INVENTION

The stage and thread assembly known as the refeed, disclosed in co-pending U.S. patent application Ser. No. 08/734,632, the entire disclosure of which is herein incorporated by reference, had to singulate an envelope off a stack of ten to twenty envelopes and then present it to the threading roller for threading on the packing plate and insertion of material into the envelope. This design has a number of drawbacks.

For example, the stacking of envelopes prior to refeeding, in an area referred to as the understack, was very difficult to regulate at any constant height or number. This made it very difficult for the refeed apparatus to singulate an envelope therefrom with any consistency. Further, the prompter device which was used to pull envelopes off the top of the stack consisted of a threaded belt mounted above the stack. The prompter was turned on when it was time to pull an envelope from the stack; however, the belt often slipped on the envelope, thus missing the window of opportunity for the next insertion. Finally, the device which presented the envelope to the threading roller, known as the singulator, was very inconsistent in such presentation because the angle the envelopes entered the singulator varied due to an ever changing height of the stack of envelopes.

BRIEF SUMMARY OF THE INVENTION

The present invention comprises a stage and thread assembly for use in a high speed envelope packing apparatus. The assembly receives from the side, a single envelope with flap open. The assembly precisely aligns and positions the envelope in a pre-stage area via a plurality of entry ramps, continuously running belts, and back stops so as to rectify any misalignment. Once positioned in the pre-stage area, the apparatus stages the envelope in a position above the thread roller so that it can be threaded on the packing plate for insertion. The staging of the envelope is achieved via a plurality of rollers including, d-rollers, flipper rollers, and stage rollers. The envelope is staged in a direction perpendicular to the direction of entry of the envelope.

Accordingly, it is the principal object of the present invention to provide an improved stage and thread apparatus for a high speed envelope packing apparatus.

It is a further object of the present invention to provide an apparatus which can receive envelopes with flap open from the side and precisely align the same, rectifying any misalignment.

It is also an object of the present invention to provide an apparatus which can receive envelopes with flap open from the side and precisely align the same, and then move the same in a direction perpendicular to the direction of entry.

It is an additional object of the present invention to provide an apparatus which can receive envelopes with flap open from the side and precisely align the same, and then move the same in a direction perpendicular to the direction of entry to stage the envelope above a thread roller.

Numerous other advantages and features of the present invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
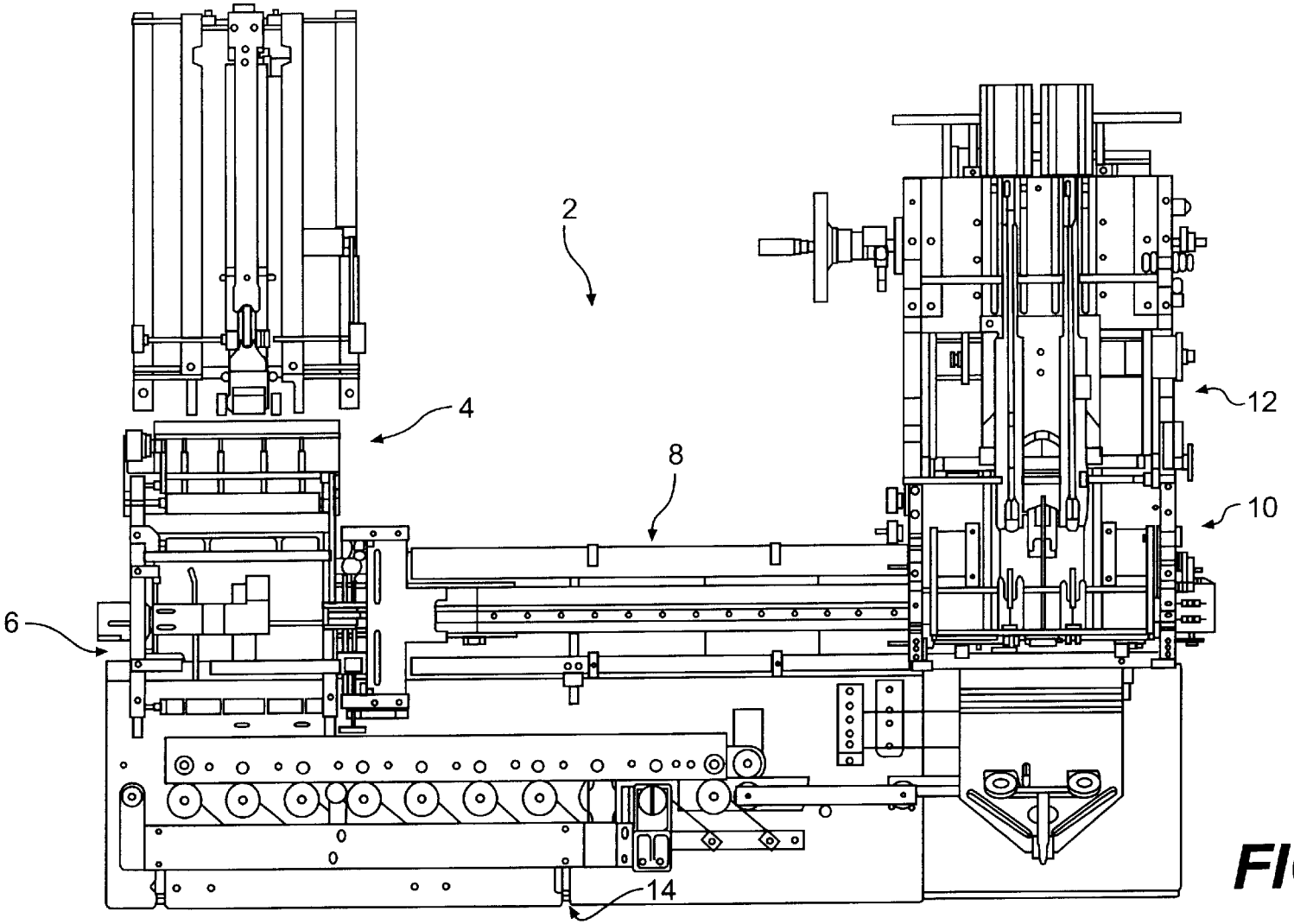
FIG. 1 is a top view of a high speed envelope packing apparatus.

While the present invention is susceptible to embodiment in many different forms, there are shown in the drawings and will be described herein in detail, a preferred embodiment of the invention. It should be understood however that the present disclosure is to be considered an exemplification of the principals of the invention and is not intended to limit the spirit and scope of the invention and/or claims of the embodiment illustrated.

FIG. 1 illustrates generally an envelope packing apparatus 2, comprising an envelope feeding assembly 4, a first staging assembly 6, a conveyor 8, a second staging assembly 10, an envelope packing assembly 12, and an exit conveyor 14. The present invention is positioned and used in an envelope packing apparatus as the second staging assembly.

Figure 2:
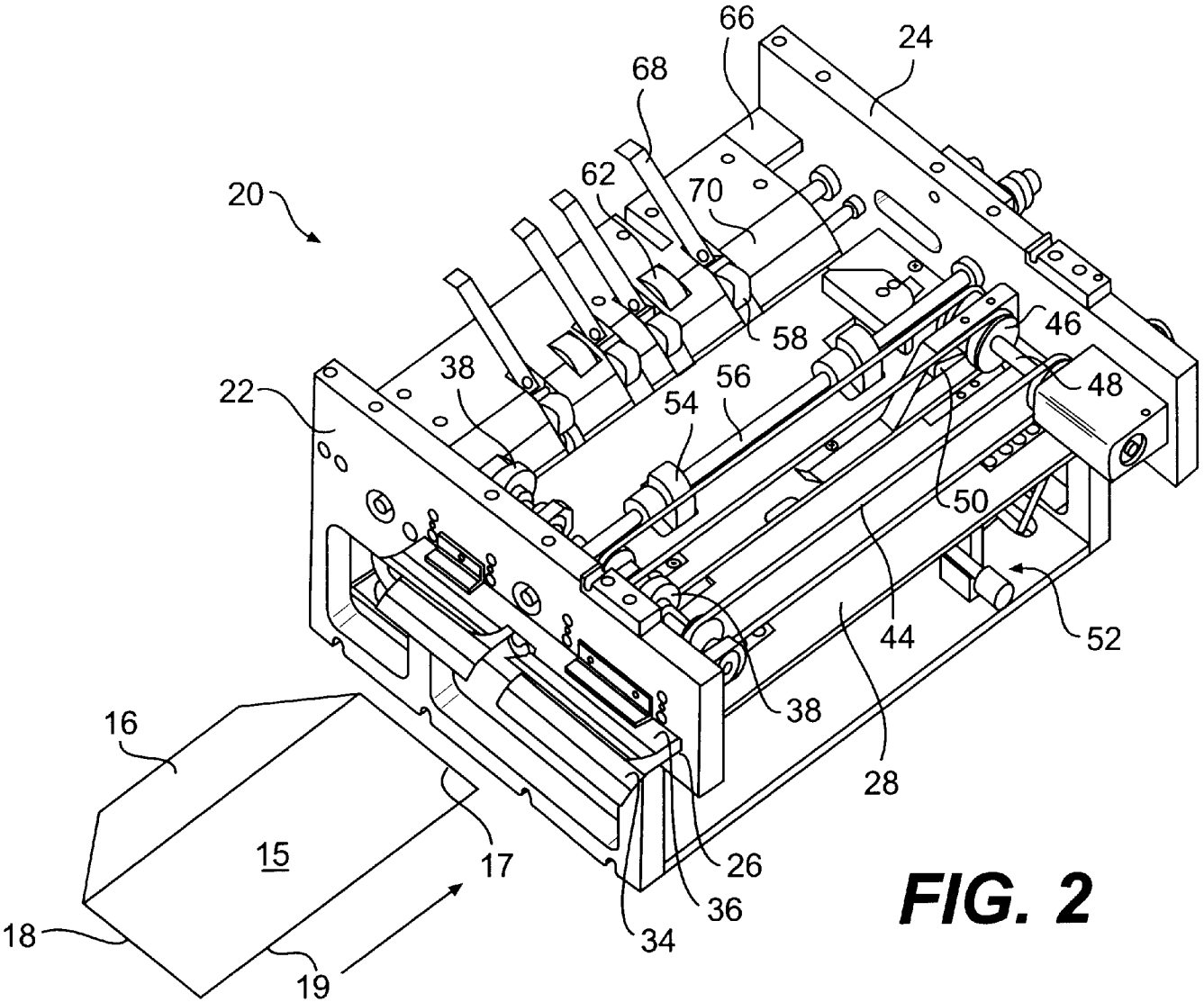
FIG. 2 is a perspective view of present invention.

FIG. 2 illustrates the stage and thread assembly 20 of the present invention. Assembly 20 receives envelopes 15, having a flap 16, a leading edge 17, a trailing edge 18 and a bottom edge 19, from the conveyor 8 (FIG. 1). Assembly 20 then stages the envelope, and subsequently threads the envelope to the envelope packing assembly 12 (FIG. 1).

Stage and thread assembly 20 comprises a side plate (entry side) 22, a side plate (drive side) 24, an entry slot 26, a deck plate 28, a bottom entry guide 34, a top entry guide 36, pre-stage rollers 38, entry ramps 42 (FIG. 4), continuous running belts 44, pulleys 46, shaft 48, back stops 50, rack & pinion assembly 52, D-rollers 54, shaft 56, flipper rollers 58, stage rollers 62, ramp support plate 66, spring guides 68, and ramp 70.

Figure 3:
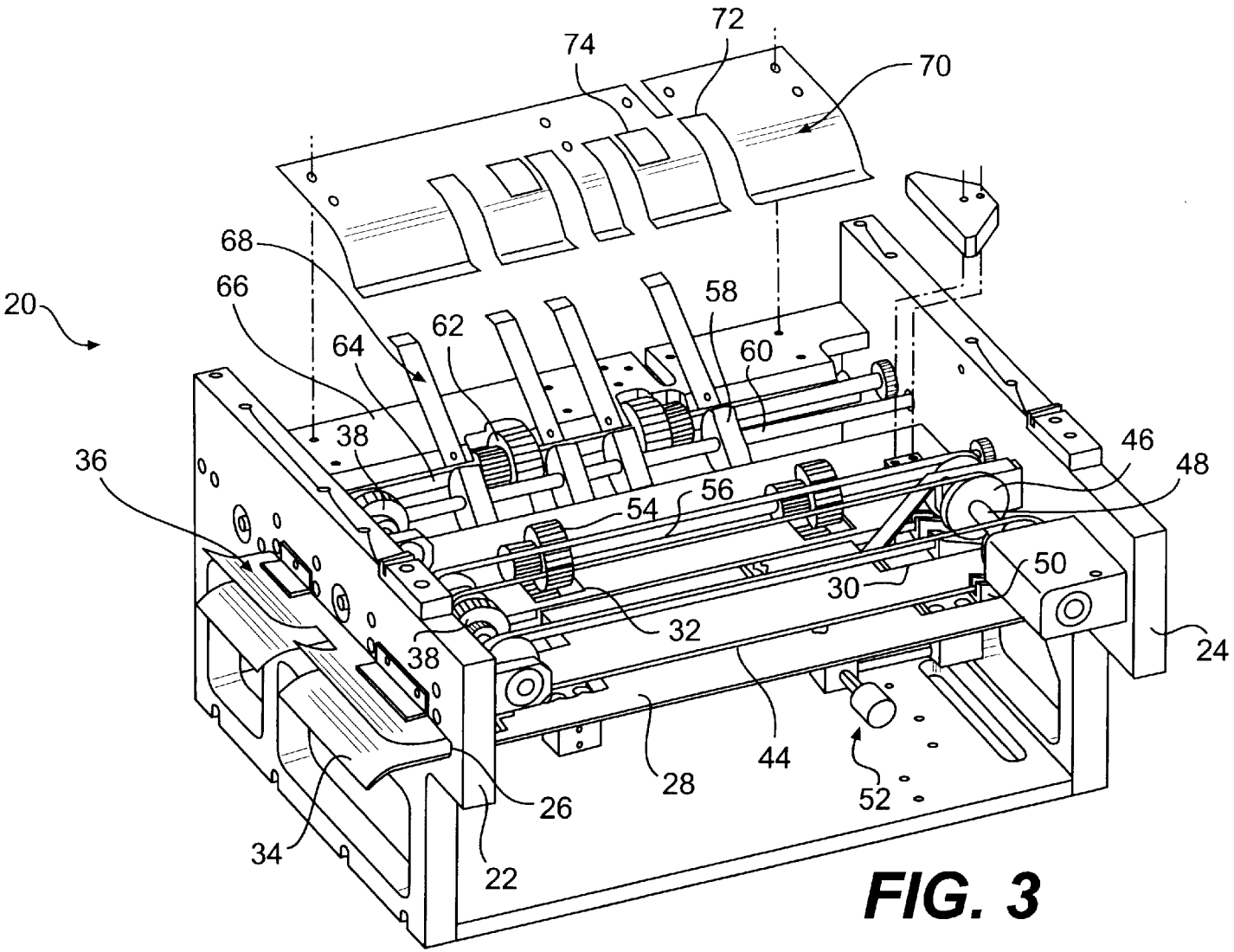
FIG. 3 is a partial exploded perspective view of the present invention.

In FIG. 3, assembly 20 is shown with the ramp 70 in an exploded view. Again, as can be seen, assembly 20 comprises side plates 22 and 24. Side plate 22 includes entry slot 26 therein and having bottom entry guide 34 and top entry guide 36 positioned at the entry slot for guiding envelopes therethrough. Supported between side plates 22 and 24 at a level just below entry slot 26 is a deck plate 28 for supporting envelopes inserted into assembly 20. Deck plate 28 includes various slots 30 (FIG. 4) and openings 32 which receive the various rollers, ramps and stops of the present invention.

Further seen in FIG. 3 are continuously running pre-stage rollers 38 which pull the envelopes into the assembly 20. Continuous running belts 44, which are positioned around pulleys 46 mounted on shafts 48, then pull the envelopes over entry ramps 42 (FIG. 4) until reaching back stops 50, at which time the envelope is positioned on deck plate 28, under belts 44 and between ramps 42 and stops 50. The continuous running pre-stage rollers and continuously running belts are both driven by the same drive assembly including a motor (not shown). As the pre-stage rollers and belts are continuously rotating, they continue to force the envelope over the entrance ramps 42 and into the back stops 50 until the entire envelope clears the entrance ramps and rests on deck plate 28. In this manner, if the envelopes are received at an undesired, skewed or misaligned angle, the angle of the envelope will be corrected, as desired, by cooperation of the belts, ramps and stops. The contact with the three ramps, the belts, and the back stops from the continued force upon the envelope, properly aligns any misaligned envelopes. The entry ramps 42 and back stops 50 are mounted on a rack and pinion assembly 52 so they can be adjusted symmetrically to envelopes of differing sizes, for example from 7½ inches to 9½ inches in length.

Also seen in FIG. 3 are D-rollers 54 mounted on shaft 56, flipper rollers 58 mounted on shaft 60, and stage rollers 62 mounted on shaft 64. Also seen are ramp support plate 66 having spring guides 68 mounted thereto. Ramp 70, having slots 72 and roller openings 74, mounts to plate 66 and guides the envelopes up the ramp to spring guides 68.

Figure 4:
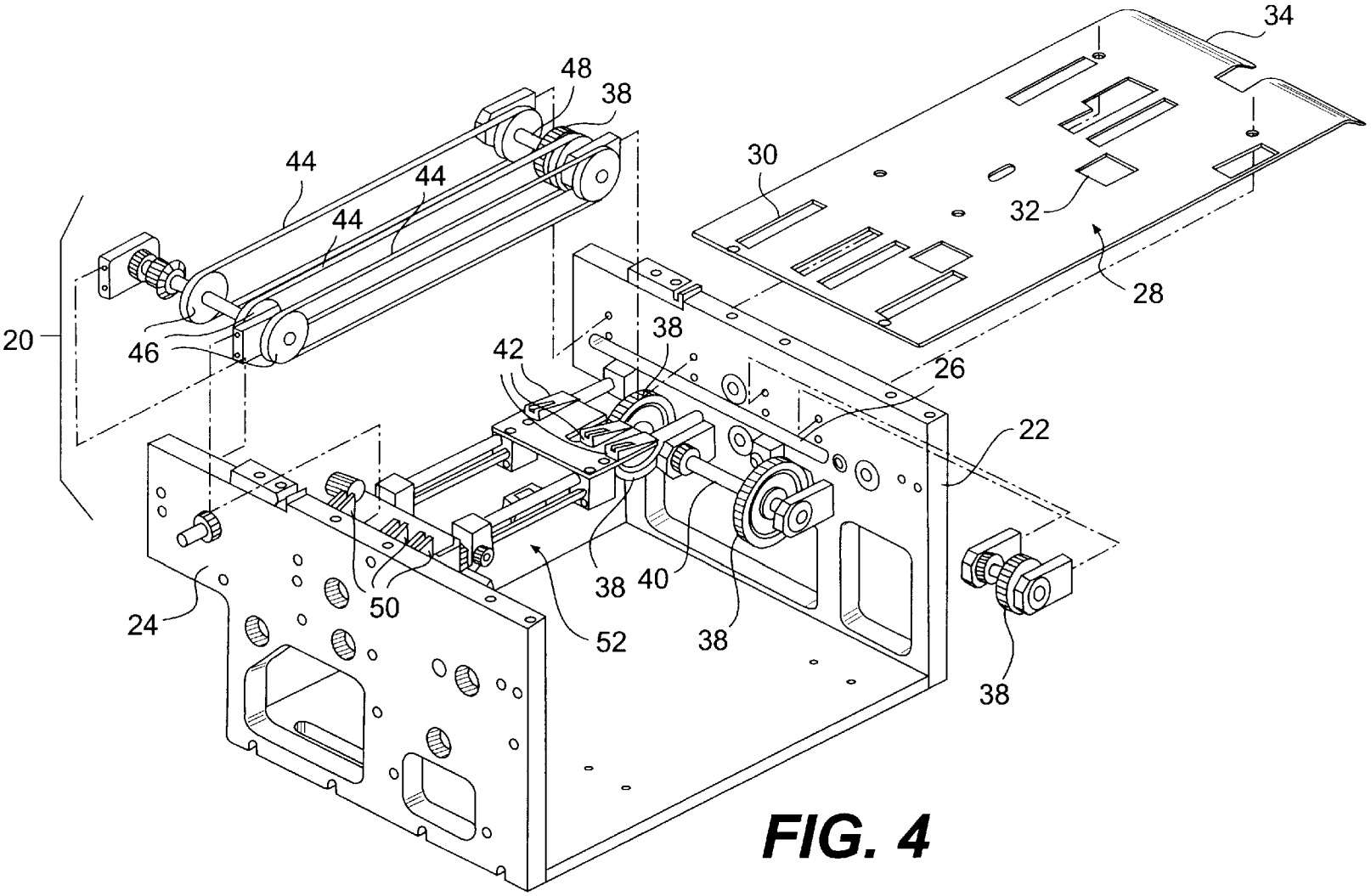
FIG. 4 is another partial exploded perspective view of the present invention.
Figure 17:
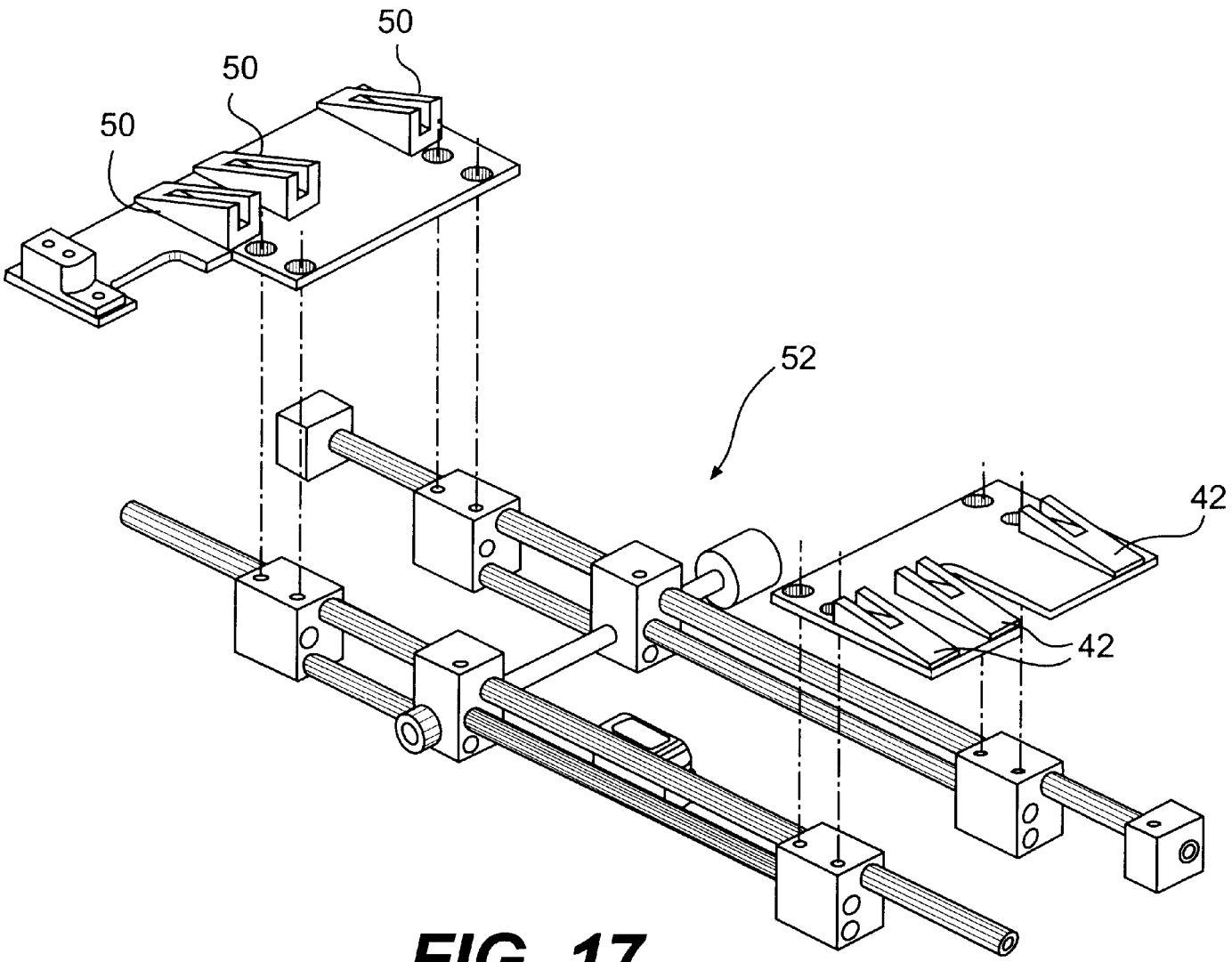
FIG. 17 is a partial exploded perspective view of the rack and inion assembly of the present invention.

FIG. 4 illustrates the deck plate 28, pre-stage rollers 38, continuous running belts 44 and rack and pinion assembly 52 of assembly 20 in a partially exploded view. Deck plate 28 is shown having various slots 30 and openings 32 for receiving ramps 42, stops 50, pre-stage rollers 38 and D-rollers 54 (FIG. 3). Pre-stage rollers 38 include two larger bottom rollers mounted on shaft 40, and two smaller top rollers positioned above the bottom rollers at the entry slot 26 in side plate 22. Continuous running belts 44, preferably but not necessarily totalling three as illustrated, are positioned directly above and in line with ramps 42 and stops 50. Ramps 42 and stops 50 include notches (as best seen in FIG. 17) therein for receiving belts 44. Belts 44 are mounted around opposing pulleys 46 mounted on shafts 48. Ramps 42 and stops 50 are mounted to the rack and pinion assembly 52.

Figure 5:
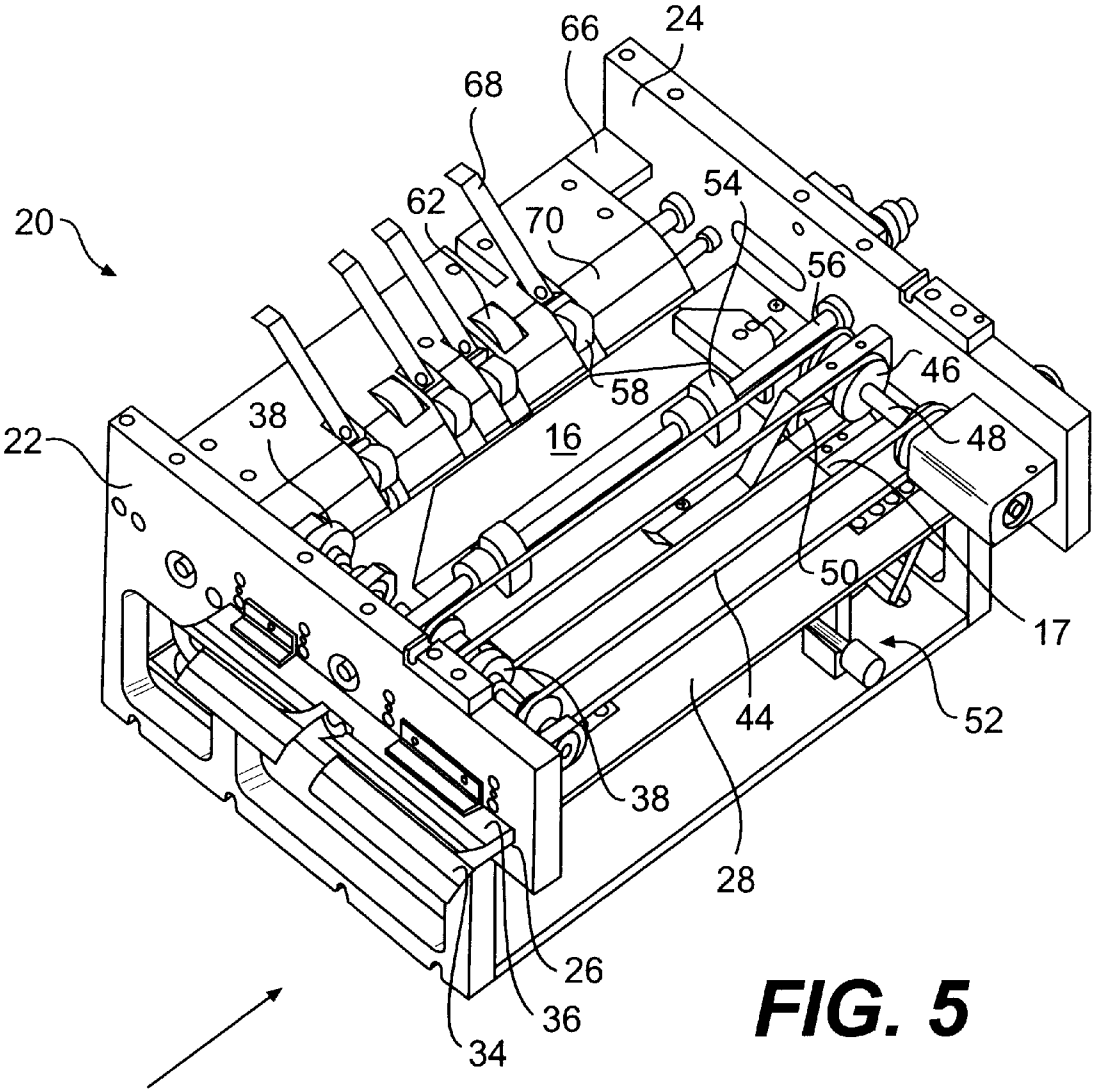
FIG. 5 is perspective view of the present invention with an envelope in the pre-stage area.

FIG. 5 illustrates envelope 15 having been positioned in assembly 20, on deck plate 28, between ramps 42 and stops 50. At this time, the D-rollers 54 and flipper rollers 58 are in their home position. Stage rollers 62 are turned on at this time and run until the envelope is staged on the packing plate 82 (FIG. 10) of the envelope packing assembly 12.

Figure 6:
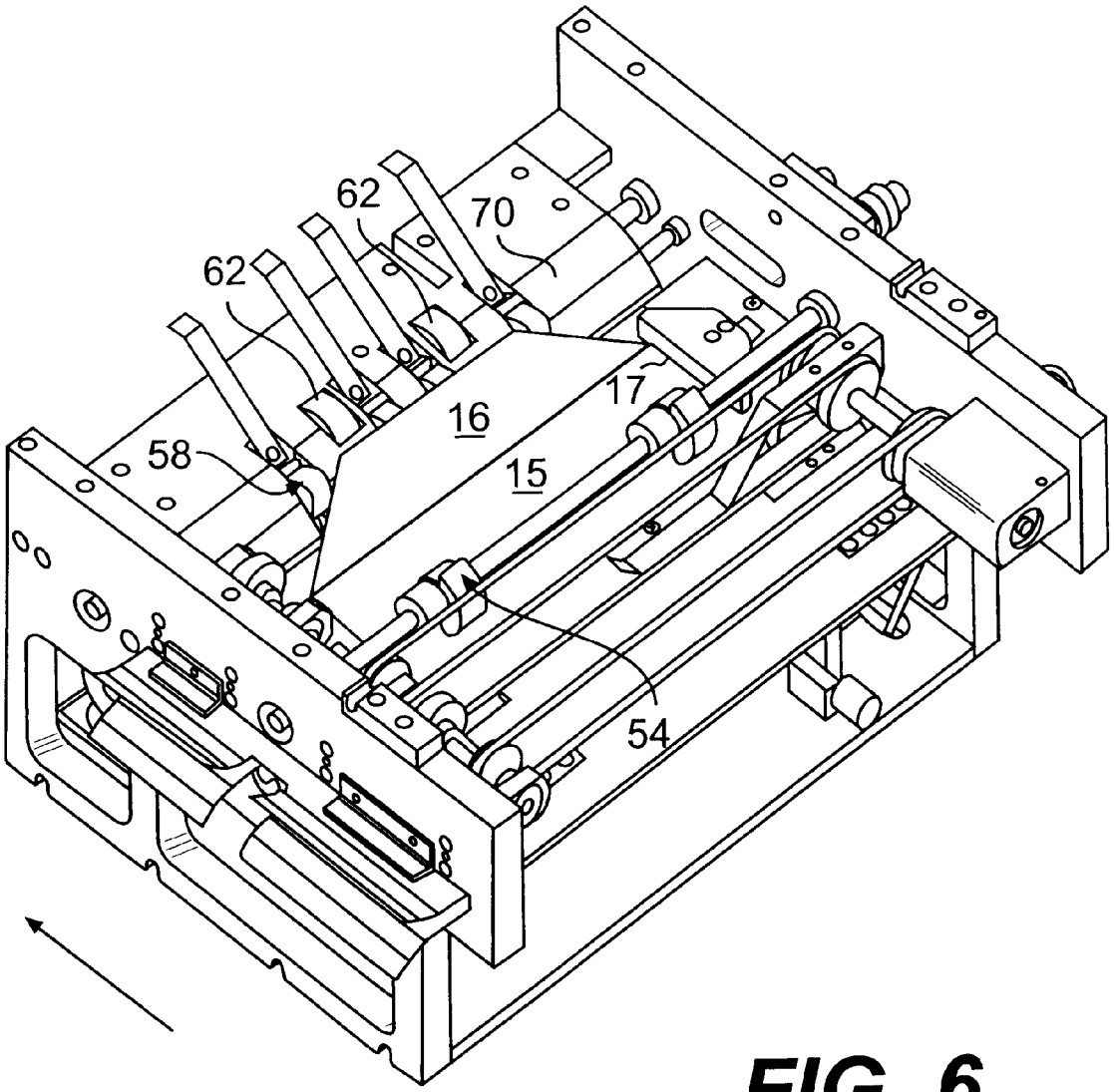
FIG. 6 is a perspective view of the present invention with an envelope moving out of the pre-stage area.
Figure 7:
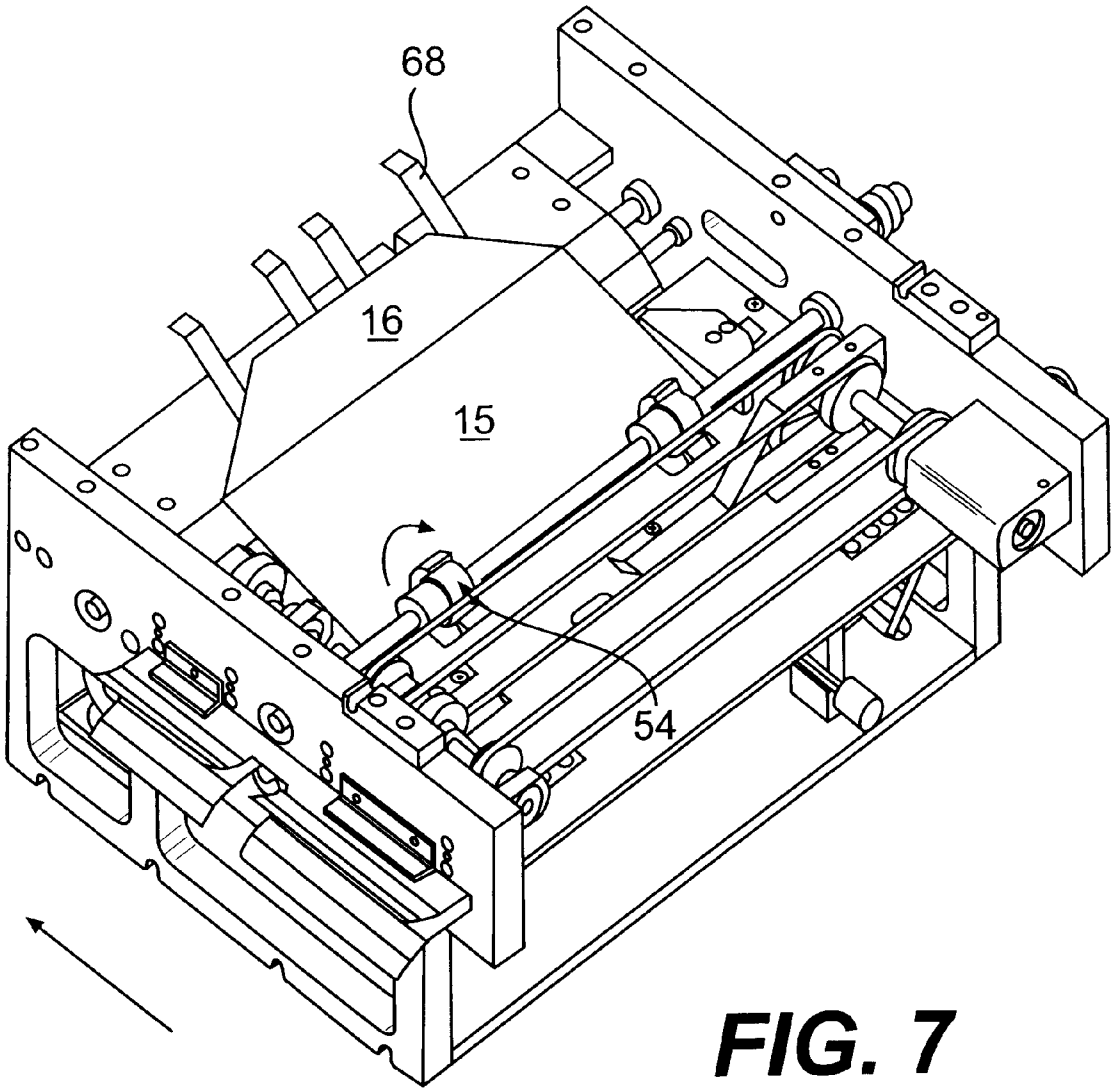
FIG. 7 is a perspective view of the present invention with an envelope exiting the pre-stage area.

FIG. 6 illustrates envelope 15 moving out of the pre-stage area it is in as illustrated FIG. 5, and towards the stage rollers 62, via rotation on the D-rollers 54. At this time, the flipper rollers 58 are turned on at this time and rotate to bias flap 16 upward toward stage rollers 62. FIG. 7 illustrates envelope 15 moving completely out of the pre-stage area, and onto the stage rollers.

Figure 8:
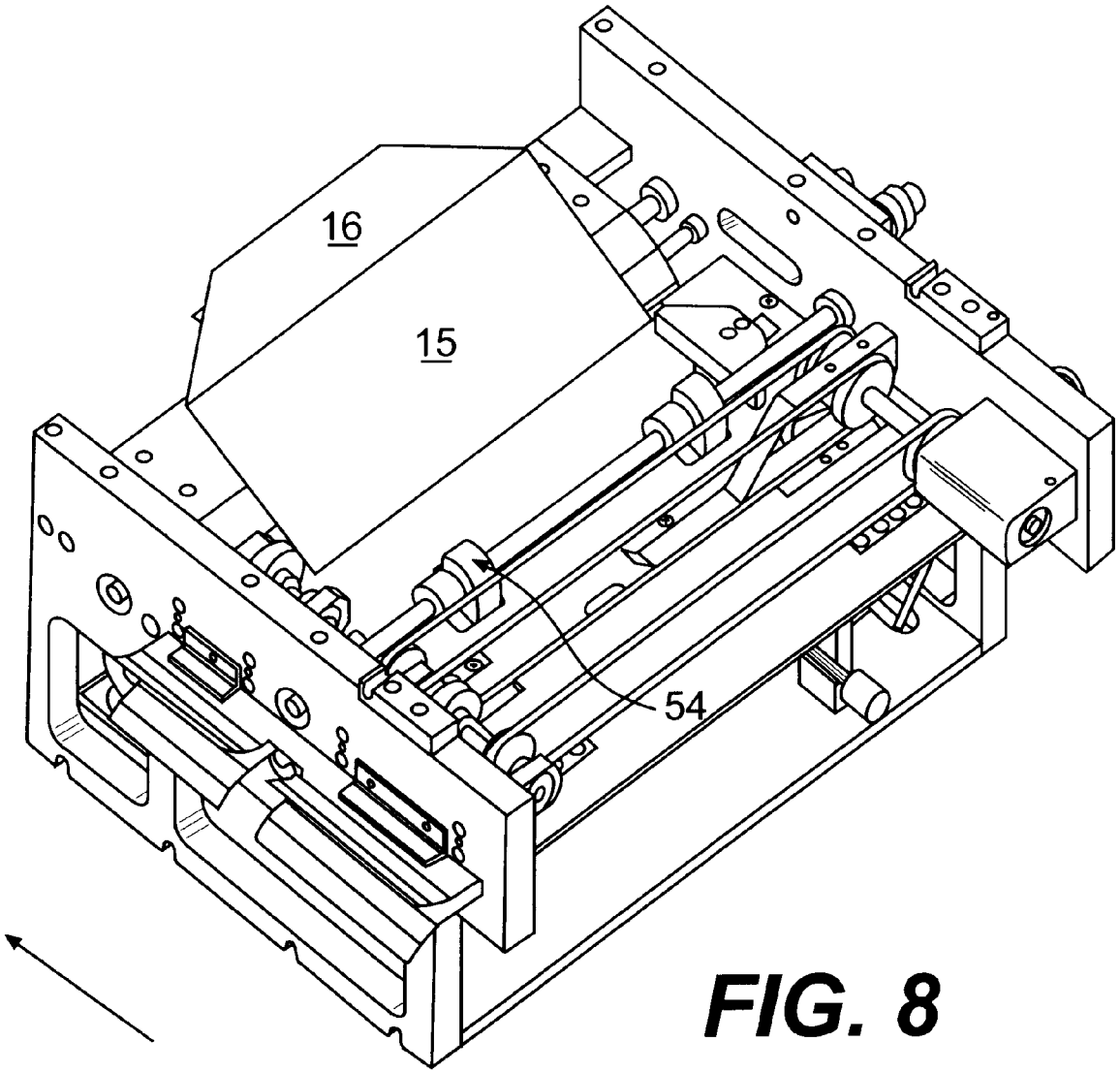
FIG. 8 is a perspective view of the present invention with an envelope moving to its staged position.
Figure 10A:
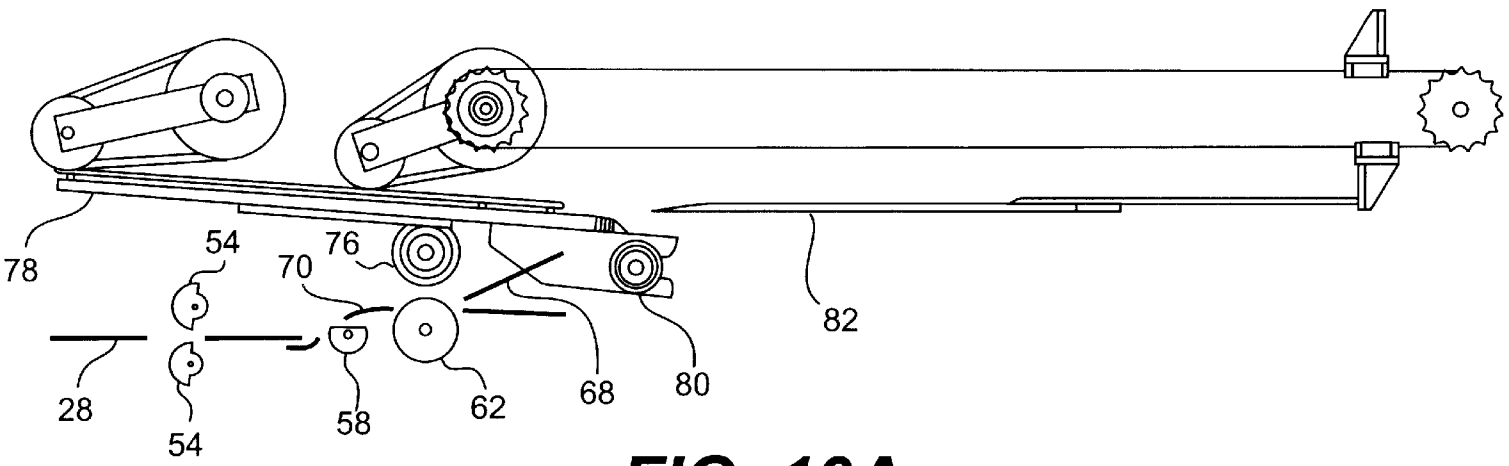
FIG. 10A is a schematic view of the present invention relative to the packing plate and the discharge plate in its lowered position.

FIG. 8 illustrates envelope 15 moving towards it fully staged position to be threaded onto packing plate 82 (FIG. 10). At this time, the envelope 15 is clamped between the stage rollers 62 and the stage idler roller 76 mounted to the discharge plate 78 as illustrated in FIG. 10A. Also at this time, the D-rollers 54 return to their home position.

Figure 9:
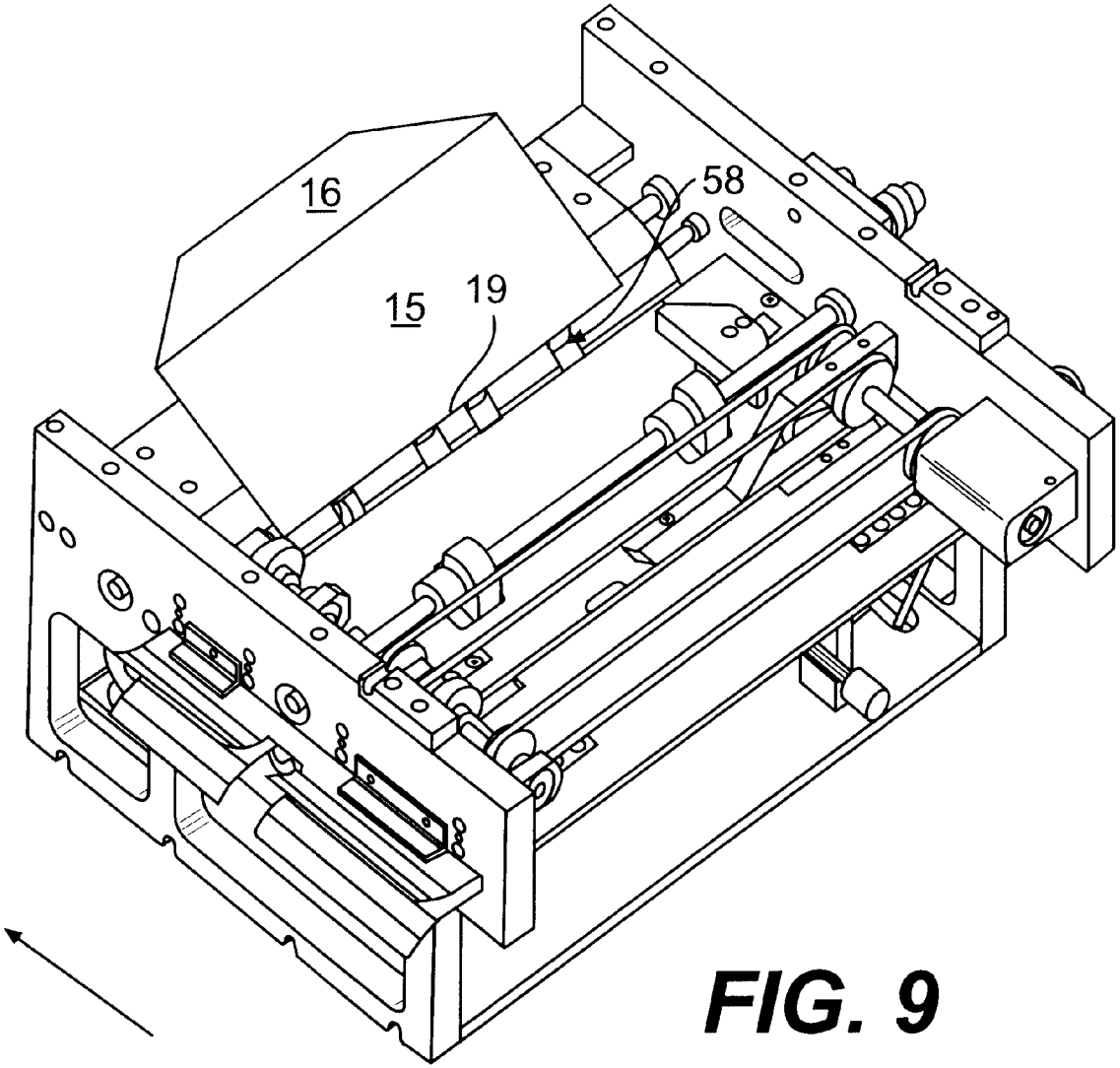
FIG. 9 is a perspective view of the present invention with an envelope in its fully staged position.
Figure 10B:
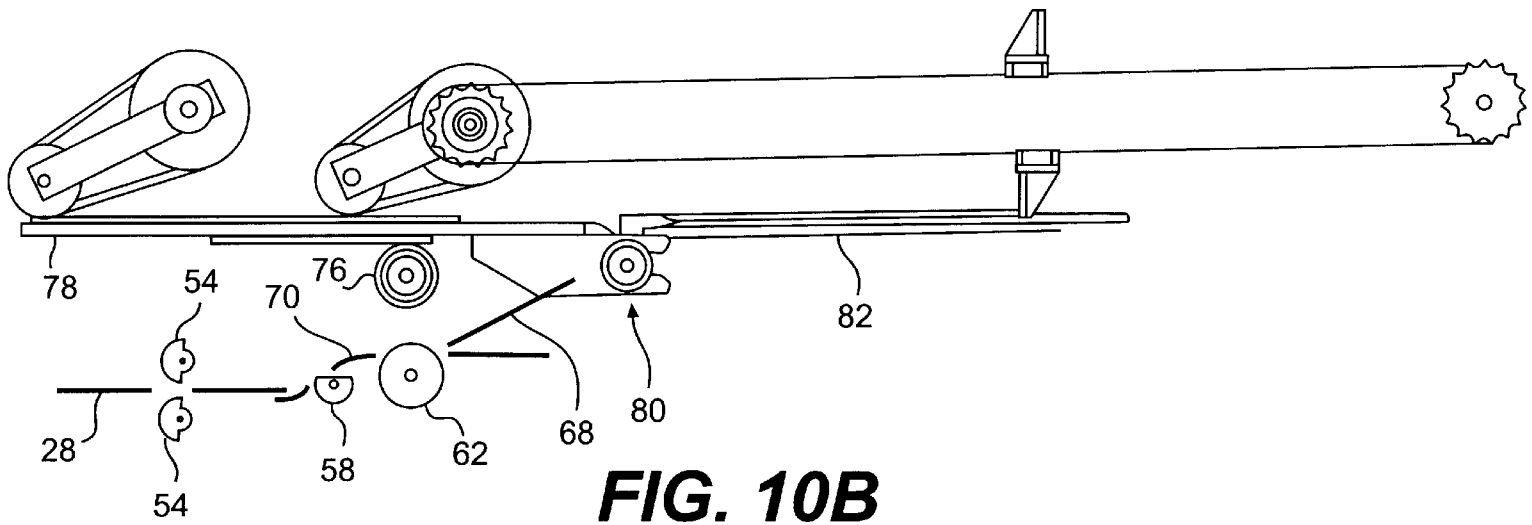
FIG. 10B is a schematic view of the present invention relative to the packing plate and the discharge plate in its raised position.

FIG. 9 illustrates envelope 15 fully staged and positioned to be threaded onto packing plate 82 (FIG. 10), having been moved by the stage rollers 62 and stage idler rollers 76 to the thread roller 80 mounted to discharge plate 78, as illustrated in FIG. 10B. At this time, the stage rollers 62 shut off. Also at this time, the flipper rollers 58 return to their home position and hold the bottom edge 19 of the envelope 15 up and out of the way of the way of the next incoming envelope.

FIGS. 10A and 10B illustrate the present invention in relation to the discharge plate 78 and the packing plate 82. As previously described, the envelope 15 is positioned in the pre-stage area upon deck plate 28. The envelope is then moved out of the pre-stage area by rotation of the D-rollers 54. Flipper rollers 58 rotate to bias the flap up ramp 70. The D-rollers 54 move the envelope over stage rollers 62. As illustrated in FIG. 10A, discharge plate 78 is lowered such that the envelope is clamped between stage roller 62 and stage idler roller 76. Rotation of stage roller 62 then moves the envelope up spring guides 68 and onto thread roller 80. As illustrated in FIG. 10B, discharge plate 78 is raised to nip the envelope flap between the thread roller 80 and the packing plate 82. Rotation of thread roller 80 thus threads the envelope onto the packing plate 82.

Figure 11:
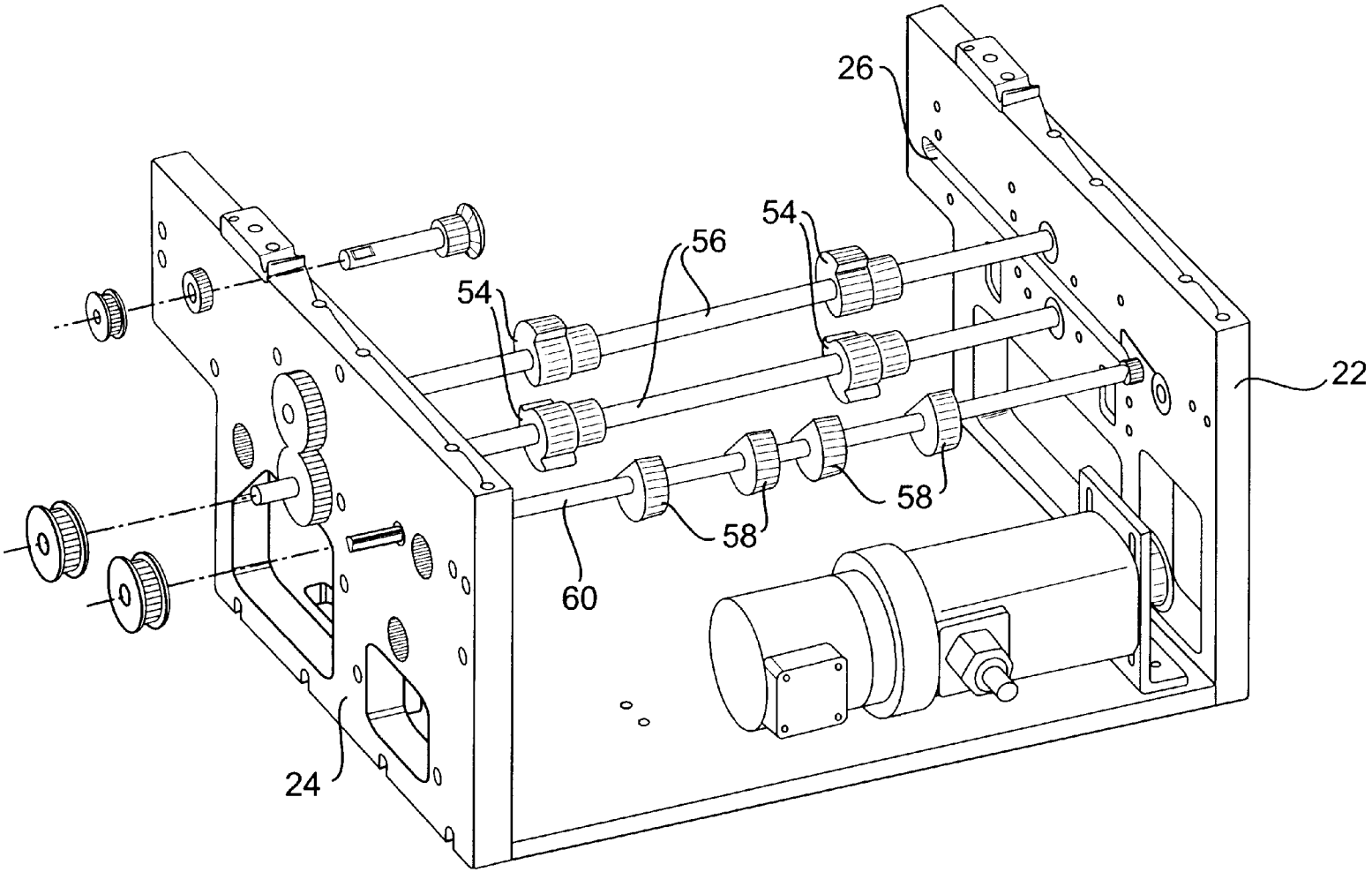
FIG. 11 is a perspective view the D-rollers and flipper rollers of the present invention.
Figure 12:
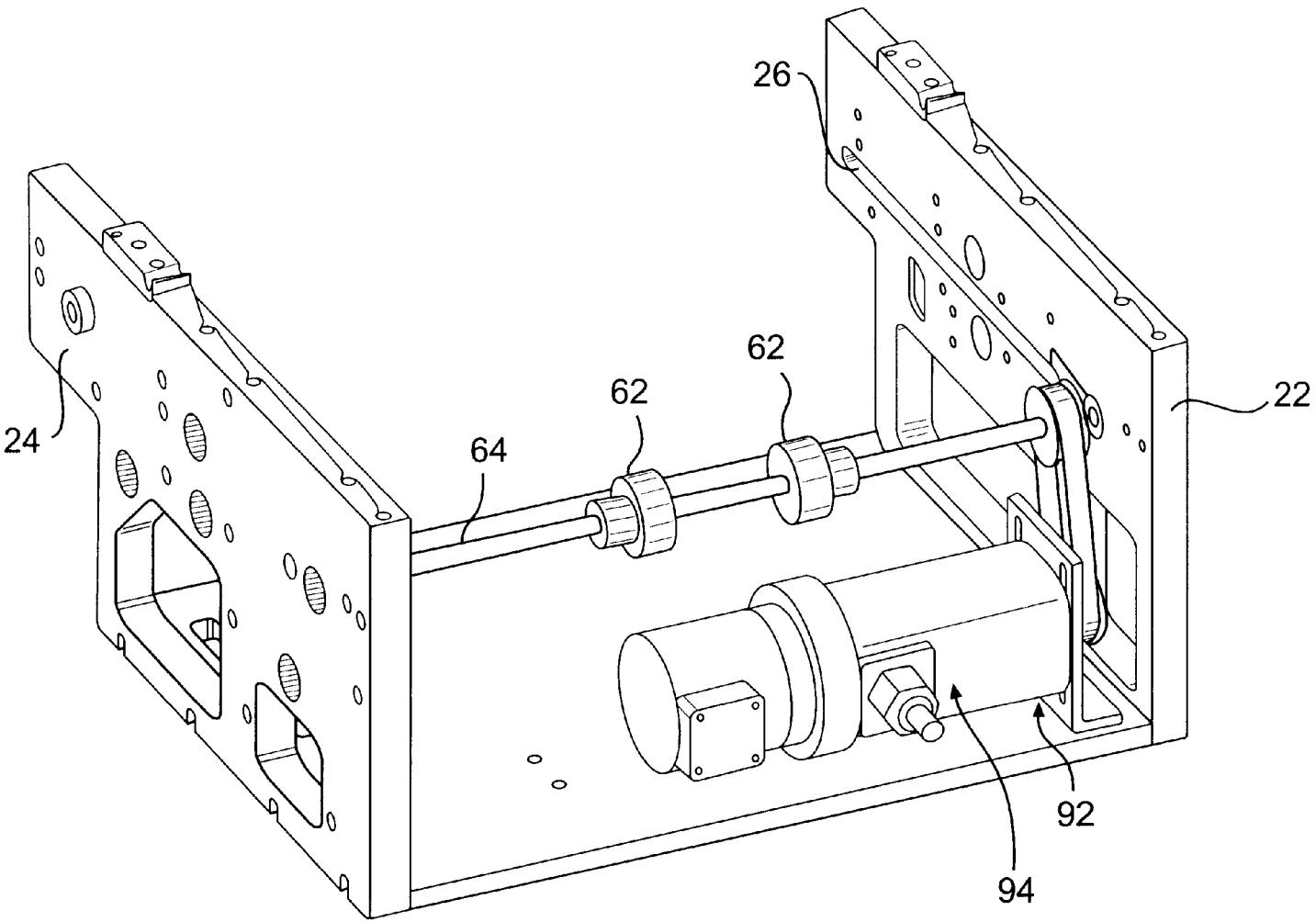
FIG. 12 is a perspective view of the stage rollers of the present invention.

FIG. 11 illustrates the D-rollers 54 mounted on shaft 56, and the flipper rollers 58 mounted on shaft 60, between side plated 22 and 24. FIG. 12 illustrates the stage rollers 62 mounted on shaft 64, between side plated 22 and 24. Also seen in FIG. 12 is drive assembly 92 including motor 94 for selectively rotating stage rollers 62.

Figure 13:
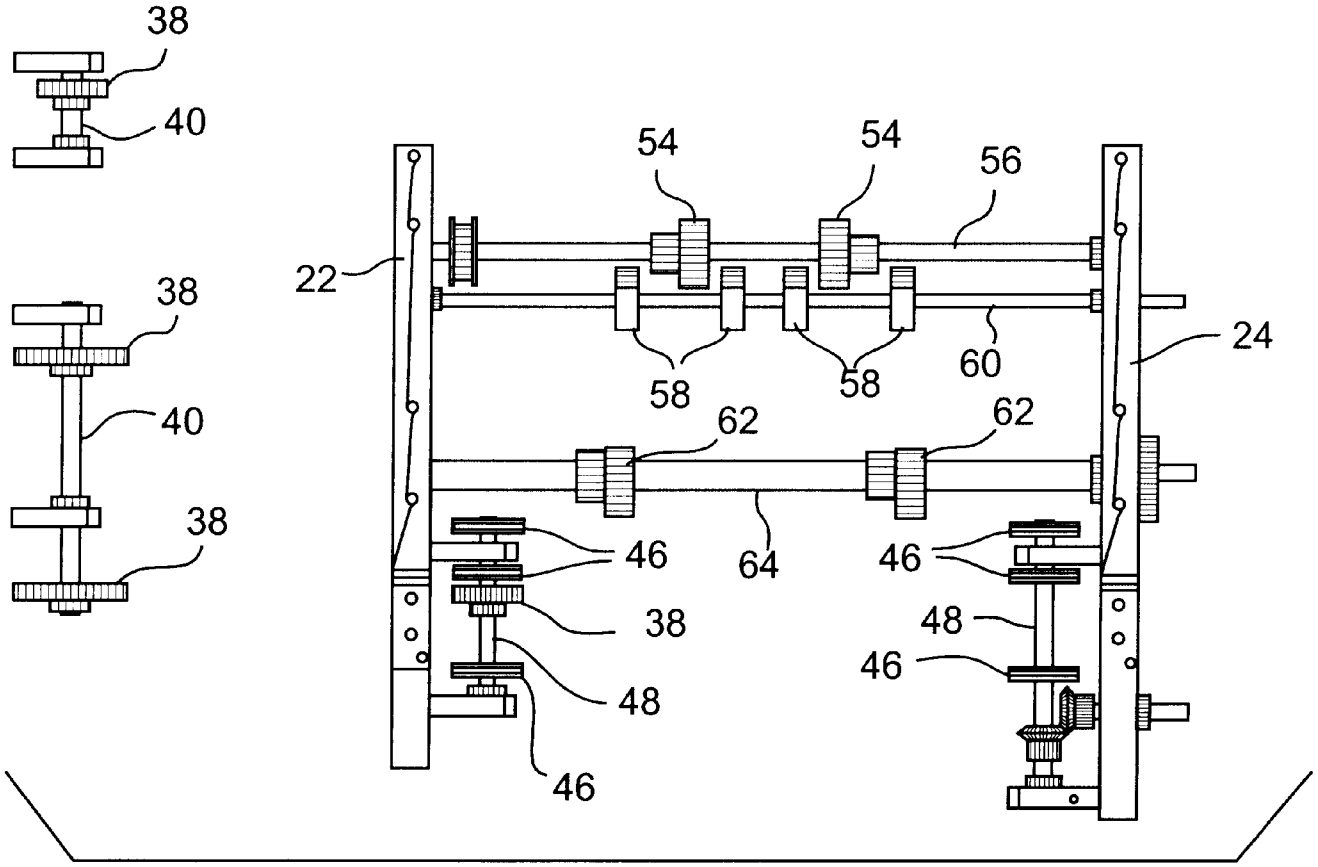
FIG. 13 is a top view of the rollers of the present invention.

FIG. 13 illustrates a top view of the D-rollers 54, flipper rollers 58, stage rollers 62 and pulleys 46 of the present invention, with the three of the four pre-stage rollers 38 in an exploded view.

Figure 14:
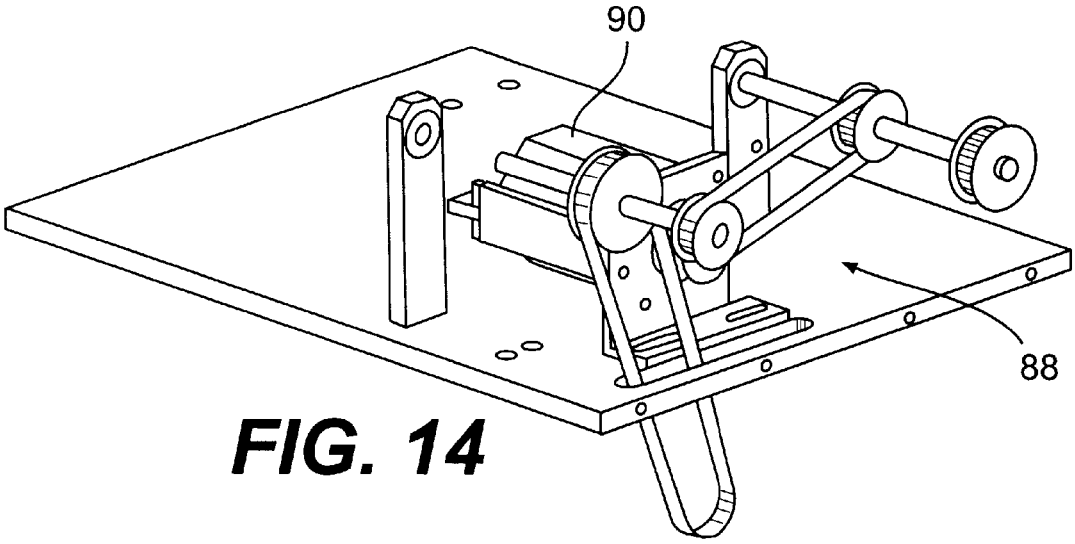
FIG. 14 is a perspective view of the drive assembly of the present invention.
Figure 15:
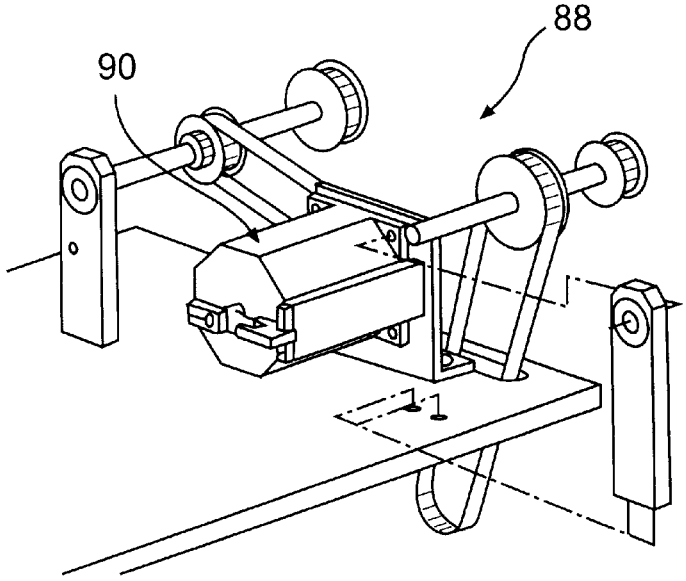
FIG. 15 is a reverse perspective view of drive assembly of FIG. 4.
Figure 16:
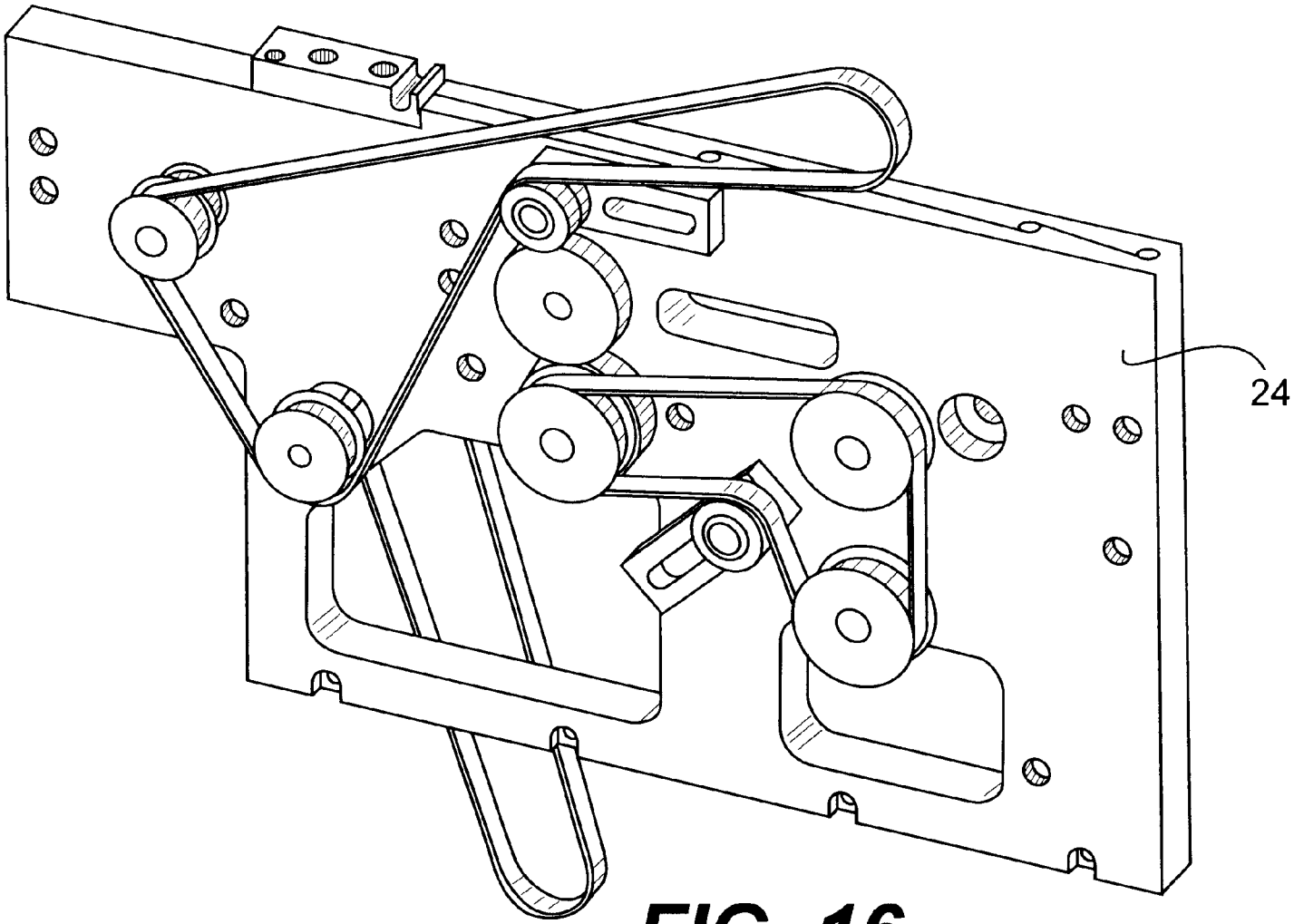
FIG. 16 is a perspective view of an additional drive assembly the resent invention.

FIGS. 14 and 15 illustrate another drive assembly 88 including motor 90 of the present invention. Drive assembly 88 selectively rotates D-rollers 54 and flipper rollers 58. FIG. 16 illustrates various pulleys and belts suitably positioned to effectuate rotation of the D-rollers and flipper rollers by drive assembly 88. It should be understood that any number of pulleys and belts, and any number of drive assemblies and motors could be organized in one or more positions to effectuate proper rotation of the flippers as desired.

Figure 18:
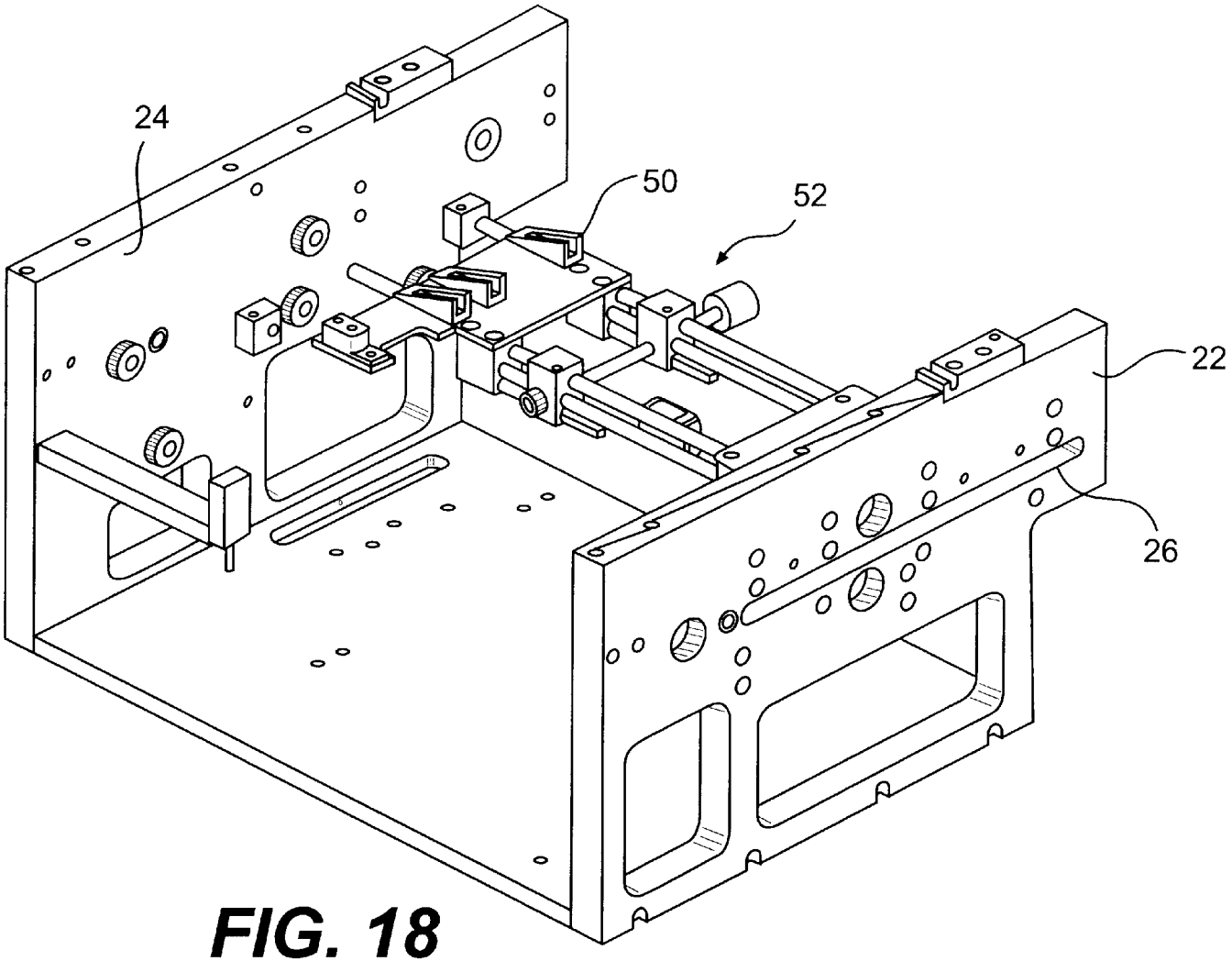
FIG. 18 is a perspective view of the rack and pinion assembly of the present invention.

FIGS. 17 and 18 illustrate ramps 42 and stops 50 mounted to rack and pinion assembly 52 substantially as shown. Rack and pinion assembly allow for adjustment of the ramps and stops as previously described.

In the manner describe above, envelopes are received in one direction, precisely positioned or aligned in a prestage area, even if received at an angle, and then selectively removed in a direction ninety degrees to the direction of entry, and precisely positioned on over the thread roller for threading on the packing plate.

It is to be understood that the embodiments herein described are merely illustrative of the principals of the present invention. Various modifications may be made by those skilled in the art without departing from the spirit or scope of the claims which follow. For example, it is foreseen that the specific number of rollers of each type described herein, as well as the drive assemblies, could be modified without departing from the spirit or scope of the present invention. Further, it is foreseen that the present invention could be used any time it is desired to make precise and controlled, ninety degree turns with envelopes or other paper material.

What is claimed is:

1. A staging assembly for staging and threading an envelope to an envelope packing assembly having an envelope packing plate and a discharge plate, said staging assembly comprising:

means for receiving an opened envelope;

means for positioning said opened envelope in a pre-stage position;

means for positioning said opened envelope in a fully staged position, said means for positioning in a fully staged position includes at least one stage roller; and roller means on said discharge plate for cooperatively positioning said envelope in a fully staged position on said packing plate, said roller means including a first roller selectively engaging said at least one stage roller to move said opened envelope toward said packing plate, and a second roller selectively engaging said packing plate to thread said envelope on said packing plate.

2. The assembly of claim 1, wherein said means for positioning in a pre-stage position aligns skewed envelopes.

3. The assembly of claim 1, wherein said means for positioning in a pre-stage position moves said envelope in a first direction.

4. The assembly of claim 3, wherein said means for positioning in a fully staged position moves said envelope in a second direction.

5. The assembly of claim 4, wherein said first direction is perpendicular to said second direction.

6. The assembly of claim 1, wherein said means for positioning in a pre-stage position includes at least one pre-stage roller for moving said envelope towards a pre-stage area.

7. The assembly of claim 6, wherein said means for positioning in a pre-stage position further includes at least one belt cooperatively associated with at least one ramp for moving said envelope into a pre-stage area.

8. The assembly of claim 7, wherein said at least one ramp defines the size of said pre-stage area, said at least one ramp being mounted on adjusting means for adjusting the size of said pre-stage area.

9. The assembly of claim 1, wherein said means for positioning in a fully staged position further includes at least one pair of D-rollers for receiving said envelope therebetween from a direction parallel to an axis of rotation of said at least one D-roller, and for moving said envelope out of said pre-stage position towards said at least one stage roller.

10. The assembly of claim 9, wherein said means for positioning in a fully staged position further includes at least one flipper roller for selectively elevating said envelope.

11. A method of precise, controlled movement of a stream of opened envelopes to a packing plate, proximate a discharge plate, said method comprising the steps of:

sequentially receiving said opened envelopes into a pre-stage area via means for pre-staging;

controllably removing said opened envelopes from said pre-stage area via means for staging, said means for staging including at least one stage roller;

providing on said discharge plate a nip roller for selectively engaging said at least one stage roller;

selectively positioning said nip roller on said discharge plate in association with said at least one stage roller to sequentially thread said open envelopes to said packing plate;

further providing on said discharge plate a thread roller for selectively engaging said packing plate; and selectively positioning said thread roller on said discharge plate in associate with said packing plate to sequentially thread said open envelopes on said packing plate.

12. The method of claim 11, wherein the step of receiving further includes the step of aligning skewed envelopes.

13. The method of claim 11, wherein the step of receiving includes the steps of:

moving said opened envelopes via pre-stage rollers; and aligning said opened envelopes in said pre-stage area via at least one ramp cooperatively associated with at least one belt and at least one backstop.

14. The method of claim 11, wherein the step of removing includes the step of:

moving said opened envelopes from said pre-stage area via D-rollers to said at least one stage roller.

15. An envelope staging assembly in a high speed envelope packing apparatus having a packing plate and a discharge plate, said envelope staging assembly comprising:

a housing positioned proximate said discharge plate for sequentially receiving envelopes with flaps opened;

a stage roller in said housing for controllably moving said envelopes towards said packing plate;

a nip roller on said discharge plate, said nip roller being selectively positioned to engage said stage roller with one of said envelopes therebetween when said discharge plate is in a first position; and a thread roller on said discharge plate, said thread roller being selectively positioned to engage said packing plate with one of said flaps of said envelopes therebetween when said discharge plate is in a second position.

16. A method of staging an envelope in a high speed envelope packing apparatus having a packing plate and a discharge plate, said method comprising the steps of:

sequentially receiving envelopes in a staging area proximate said discharge plate;

controllably moving said envelopes towards said packing plate via a stage roller;

selectively positioning a nip roller on said discharge plate to engage said stage roller with one of said envelopes therebetween when said discharge plate is in a first position; and selectively positioning a thread roller on said discharge plate to engage said packing plate with one of said envelopes therebetween when said discharge plate is in a second position.

* * * * *

UNITED STATES PATENT AND TRADEMARK OFFICE

CERTIFICATE OF CORRECTION

PATENT NO. : 6,240,710 B1
DATED : June 5, 2001
INVENTOR(S) : Button et al.

It is certified that error appears in the above-identified patent and that said Letters Patent is hereby corrected as shown below:

Column 2,
Line 54, "FIG. 4" should read -- FIG. 14 --;
Line 56, delete "resent" and insert -- "present" -- to read "the present invention"; and
Line 59, delete "inion" and insert -- pinion -- to read "and pinion assembly of the present invention"

Signed and Sealed this

Eleventh Day of December, 2001

*Attest:*

Nicholas P. Godici

*Attesting Officer*

NICHOLAS P. GODICI
*Acting Director of the United States Patent and Trademark Office*